United States Patent [19]

Bryan

[11] 4,335,652

[45] Jun. 22, 1982

[54] NON-ELECTRIC DELAY DETONATOR

[75] Inventor: Paul J. Bryan, Hewitt, N.J.

[73] Assignee: E. I. Du Pont de Nemours & Company, Wilmington, Del.

[21] Appl. No.: 177,210

[22] Filed: Aug. 11, 1980

Related U.S. Application Data

[63] Continuation-in-part of Ser. No. 15,288, Feb. 26, 1979, abandoned.

[51] Int. Cl.[3] ..... F42C 15/00

[52] U.S. Cl. ..... 102/202.1; 102/275.3

[58] Field of Search ..... 102/202.1, 275.3

[56] References Cited

U.S. PATENT DOCUMENTS

| | | | |
|---|---|---|---|
| 2,878,752 | 3/1959 | Johnson et al. . | |
| 2,891,476 | 6/1959 | Forsyth | 102/27 R |
| 2,999,460 | 9/1961 | Stinger et al. . | |
| 3,021,786 | 2/1962 | Miller et al. . | |
| 3,122,097 | 2/1964 | Miller . | |
| 3,306,201 | 2/1967 | Noddin . | |
| 3,320,884 | 5/1967 | Kowalick | 102/27 R |
| 3,587,466 | 6/1971 | Prior | 102/27 R |
| 3,709,149 | 1/1973 | Driscoll . | |
| 3,878,786 | 4/1975 | Ridgeway | 102/27 F X |
| 3,991,679 | 11/1976 | Savitt et al. | 102/27 F |
| 4,060,034 | 11/1977 | Bowman et al. | 102/27 R X |

FOREIGN PATENT DOCUMENTS

| | | | |
|---|---|---|---|
| 627435 | 9/1961 | Canada . | |
| 2375158 | 12/1976 | France | 102/27 R |
| 8848 | of 1903 | United Kingdom | 102/27 F |
| 747278 | 3/1956 | United Kingdom | 102/27 R |

*Primary Examiner*—Peter A. Nelson

*Attorney, Agent, or Firm*—Diamond C. Ascani

[57] ABSTRACT

The ignition assembly of a non-electric delay detonator which is adapted for field-assembly with a low-energy detonating cord has an expansion shell provided with a cavity into which the cord is inserted at the time of use. The pressure pulse resulting from the detonation of the cord causes the shell to expand and an ignition charge to be actuated as a result of sudden compression between the expansion shell and a rigid ignition capsule. The burning ignition charge causes the ignition of a delay charge, which in turn ignites a priming charge, causing the base charge to detonate. The presence of ignition charge in an annular spacing between the expansion shell and ignition capsule walls, as well as between the shell and capsule ends, and the proper positioning of a cord-gripping means, preferably in the shell cavity, assure actuation of the ignition charge whether or not the cord is shoved to the bottom of the shell.

24 Claims, 4 Drawing Figures

NON-ELECTRIC DELAY DETONATOR

RELATED APPLICATION

This application is a continuation-in-part of copending United States Patent Application Ser. No. 15,288, filed Feb. 26, 1979, and now abandoned.

BACKGROUND OF THE INVENTION

1. Field of the Invention

The present invention relates to a non-electric delay detonator, and to an assembly of a delay detonator and a low-energy detonating cord adapted to actuate the detonator.

2. Description of the Prior Art

The hazards associated with the use of electrical initiation systems for detonating explosive charges in mining operations, i.e., the hazards of premature initiation by stray or extraneous electricity from such sources as lightning, static, galvanic action, stray currents, radio transmitters, and transmission lines, are well-recognized. For this reason, nonelectric initiation through the use of a suitable detonating fuse or cord has been looked upon as a widely respected alternative. A typical high-energy detonating cord has a uniform detonation velocity of about 6000 meters per second and comprises a core of 6 to 10 grams per meter of pentaerythritol tetranitrate (PETN) covered with various combinations of materials, such as textiles, waterproofing materials, plastics, etc. However, the magnitude of the noise produced when a cord having such PETN core loadings is detonated on the surface of the earth, as in trunklines, often is unacceptable in blasting operations in developed areas. Also, the brisance (shattering power) of such a cord may be sufficiently high that the detonation impulse can be transmitted laterally to an adjacent section of the cord or to a mass of explosive which, for example, the cord contacts along its length. In the latter situation, the cord cannot be used to initiate an explosive charge in a borehole at the bottom (the "bottom-hole priming" technique), as is sometimes desired.

Low-energy detonating cord (LEDC) was developed to overcome the problems of noise and high brisance associated with the above-described 6–10 grams per meter cord. LEDC has an explosive core loading of only about 0.02 to 2 grams per meter of cord length, and often only about 0.4 grams per meter. This cord is characterized by low brisance and the production of little noise, and therefore can be used as a trunkline in cases where noise has to be kept to a minimum, and as a downline for the bottom hole priming of an explosive charge.

Until recently, most LEDC described in the art had a continuous core of a granular cap-sensitive high explosive such as PETN heavily confined in a metal sheath or one or more woven textile sheaths. An improved LEDC which is light-weight, flexible, strong, and non-conductive, detonates at high velocity, and is readily adapted to high-speed continuous manufacturing techniques is described in Belgian Pat. No. 863,290, granted July 25, 1978, the disclosure of which is incorporated herein by reference. This improved cord has a continuous solid core of a deformable bonded detonating explosive composition comprising a crystalline high explosive compound admixed with a binding agent, and a protective plastic sheath enclosing the core, no metal or woven textile layers being present around the core or sheath. Preferably, one or more continuous strands of reinforcing yarn, e.g., running substantially parallel to the core's longitudinal axis, are present outside the core. The loading of crystalline high explosive in the bonded explosive core is about from 0.1 to 2 grams per meter of length.

Because the low explosive loading of the LEDC core is insufficient to cause the detonation of explosive charges conventionally used in blasting, auxiliary means are used to relay the detonation stimulus from the cord to the charges to be initiated. Delay detonators, actuated by LEDC downlines, are used for this purpose, providing also a delay interval between the initiation of multiple charges. One such detonator, described in U.S. Pat. No. 3,021,786, has an open-ended metal capsule therein enclosing an air gap and having a central aperture. The air gap is between the end of a length of LEDC and an exothermic-burning delay composition, the initiating impulse from the detonation of the explosive core of the LEDC jumping the air gap, passing through the aperture, and igniting the exothermic-burning composition. Peripheral crimps in the side wall of the detonator shell hold the cord in place, the latter forming a plug closure at the open end of the shell, so that the cord and detonator are formed into a composite unit or assembly at the time that the detonator is manufactured.

In the cord/detonator assembly described in U.S. Pat. No. 3,122,097, the section of LEDC extending into the detonator shell has a lower looped portion positioned adjacent to the metal capsule that forms the air gap. The looped portion of cord is positioned in the shell by means of a resilient plug which is crimped in place so as to close off the open end of the shell. Here, too, the cord and detonator are formed into a composite unit or assembly at the time that the detonator is manufactured. In this assembly, the looped section of cord is said to provide improved initiation characteristics possibly due to increased confinement of the explosive core of a metal-sheathed LEDC.

In the cord/detonator assembly of U.S. Pat. No. 3,709,149, the cord is disposed outside a closed shell that contains an impact-sensitive ignition composition, held, for example, in an empty primed rim-fired or center-fired rifle cartridge casing used as an end closure for a detonator. The cord is external in its entirety to the closed interior of the detonator shell, and its end or side is in direct and abutting contact with the exterior surface of the primer end, thereby permitting utilization of either the side or end output of the cord for ignition.

Another LEDC-actuated delay detonator is described in Canadian Pat. No. 627,435. This detonator has an impact- or friction-sensitive ignition charge abutting one side of a diaphragm that can be deformed by a weak blow. The end of a length of LEDC is to be crimped into the open end of the detonator shell with its end abutting the other side of the diaphragm. The ignition of the ignition charge by the detonation of the cord abutting the diaphragm occurs by impact or friction in a manner analogous to the blow given by the firing pin of a shot gun, in contrast to ignition by heat or flame. The diaphragm fits tightly in a pocket, and the latter similarly in the detonator shell. Although this detonator is said to be capable of assembly with the cord in the field by crimping, field assembly of such a detonator presents certain problems. The necessary abutment of the cord end against the diaphragm may not always be achieved in practice in the field owing to the vagaries associated with different handlers, the effects of weather, etc. Also, foreign material could enter the shell prior to insertion of the cord, preventing the necessary cord-to-diaphragm abutting relationship. Dislodgement of the diaphragm-pocket unit also is a possibility.

LEDC-actuated delay detonators are also described in U.S. Pat. No. 3,306,201, wherein the ignition composition also is actuated by percussion of the detonation stimulus from the cord against an imperforate partition.

SUMMARY OF THE INVENTION

The present invention provides an improvement in a non-electric delay detonator adapted to be actuated by a low-energy detonating cord, preferably a cord having a core explosive loading of less than about 1 gram per meter of length, which detonator comprises a tubular metal detonator shell integrally closed at one end and containing, in sequence from the closed end, (a) a base charge of a detonating explosive composition, e.g., pressed granular pentaerythritol tetranitrate (PETN); (b) a priming charge of a heat-sensitive detonating explosive composition, e.g., lead azide; (c) a delay charge of an exothermic-burning composition, e.g., a boron/red lead mixture; and an ignition charge, e.g., a granular mixture of red lead, boron and lead azide. The improvement of the invention comprises, in said detonator, an assembly to be used in conjunction with a low-energy detonating cord for igniting the delay charge, which assembly comprises (1) a tubular rigid metal ignition capsule having one open extremity and a closure at the other extremity, said capsule being nested within the detonator shell in a manner such that the closure is directed toward the delay charge;

(2) a tubular metal expansion shell integrally closed at one end, the expansion shell being deformable and positioned coaxially within the detonator shell in a manner such as to produce a spacing between the side walls of the expansion shell and of the ignition capsule, and between the closed end of the expansion shell and the closure on the ignition capsule; and (3) a percussion-sensitive ignition charge, in the spacing between the side walls of the expansion shell and of the ignition capsule, and between the closed end of the expansion shell and the closure on the ignition capsule, said closure having an axial perforation or being adapted to be axially perforated by the burning of the ignition charge, and the delay charge being adapted to be ignited as a result of the burning of the ignition charge;

means being provided for sealing the charges in the detonator shell off from the atmosphere and for preventing the venting of gases resulting from the burning of the ignition charge, an open cavity extending from one end to the other of the expansion shell for receiving a low-energy detonating cord adapted by its detonation to produce a pressure pulse that causes the ignition of the ignition charge, and means being provided, preferably in said cavity for retaining the cord coaxially therein.

In one embodiment of the invention the closure on the ignition capsule is adjacent to the delay charge or to a tubular carrier containing the delay charge. In an alternative embodiment the closure on the ignition capsule is separated from the delay charge or carrier, e.g., by a spacer capsule having an open extremity facing the closure on the ignition capsule and a closed, axially perforated extremity seated against the delay charge.

A preferred cord-retention means consists of one or more inwardly directed teeth or prongs formed on the inside wall of the expansion shell or, preferably, on the inner end of an open-ended metal or plastic sleeve that frictionally engages the inside wall of the expansion shell.

The detonator is a self-contained, sealed unit adapted to be packaged, stored, and transported apart from the detonating cord which is used to actuate it. At the place of use it can be incorporated into a cord-detonator assembly for initiating a blasting charge wherein an end-section of a length of low-energy detonating cord is held coaxially in the cavity of the expansion shell by the cord-retention means in a manner such that the plane that passes through the end of the cord within the cavity normal to the cord axis passes preferably also through the ignition charge or, if not, is axially spaced from the plane in which the boundary of the ignition charge lies by a distance no greater than about 2.5 millimeters.

BRIEF DESCRIPTION OF THE DRAWING

In the accompanying drawing, which illustrates specific embodiments of the non-electric delay detonator, and cord/detonator initiating assembly of the invention.

and

Figure 3:
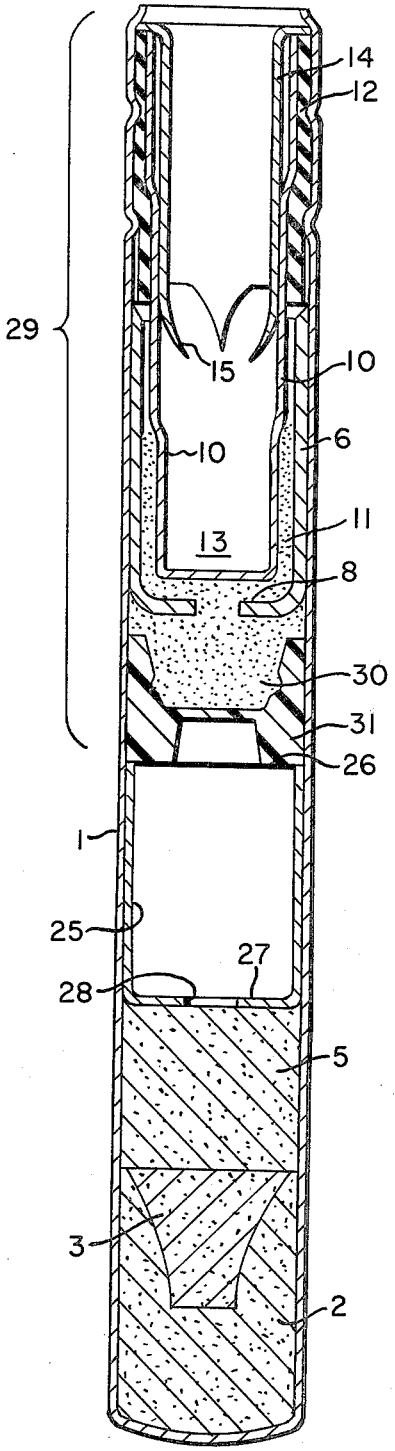
Figure 4:
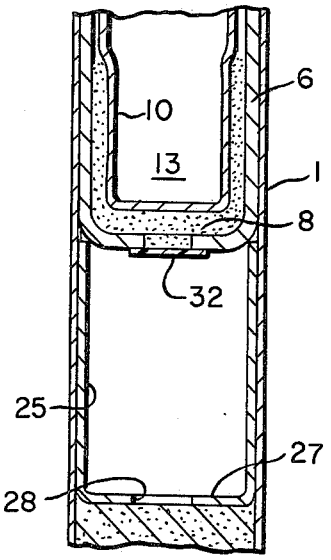

FIGS. 3 and 4 are longitudinal cross-sections of delay detonators of the invention wherein a spacer capsule is interposed between the ignition capsule and the delay charge.

DETAILED DESCRIPTION

Figure 1:
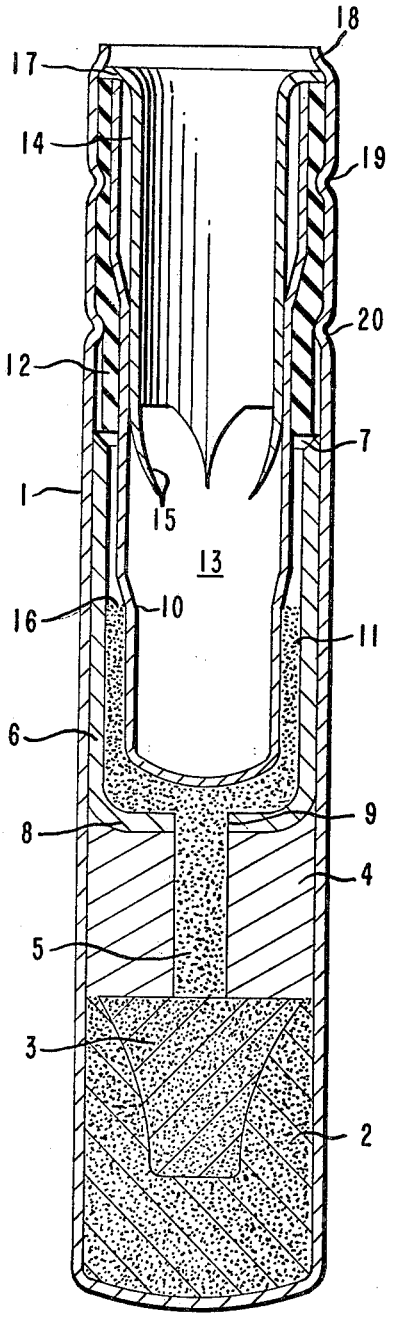
FIG. 1 is a longitudinal cross-section of a delay detonator of the invention wherein the closure on the ignition capsule is adjacent to a carrier for the delay charge.

Referring to FIG. 1, 1 is a tubular metal detonator shell having one integrally closed end, 2 is a base charge of a detonating explosive composition, 3 is a priming charge of a heat-sensitive detonating explosive composition, 4 is a delay carrier in the form of a heavy-walled tube of rigid material containing an axial core 5 of a delay charge of an exothermic-burning composition, and 6 is a tubular rigid metal ignition capsule nested within shell 1 in snug fit therein, capsule 6 having one open extremity 7, and a closed extremity 8 provided with an axial perforation 9. Closed extremity 8 of capsule 6 rests against adjacent delay carrier 4, core 5 being coaxial and in communication with perforation 9. A tubular metal expansion shell 10, which is deformable and also integrally closed at one end, is positioned coaxially within shell 1 with its closed end the innermost end in a manner such as to produce a spacing between the side walls of shell 10 and capsule 6, and between the closed end of shell 10 and the closed extremity 8 of capsule 6. A percussion-sensitive ignition charge 11 is located in this spacing. Ignition charge 11 is in contact with the delay charge in core 5 by virtue of perforation 9.

A deformable grommet or sleeve 12, e.g., one made of rubber or a plastic such as polyethylene, is sandwiched between shells 1 and 10 starting from their open ends and extending to the open extremity 7 of capsule 6. Open cavity 13, which extends from one end to the other of shell 10, acts as a well for the proper axial positioning of a detonating cord therein for the ignition of ignition charge 11. Located in cavity 13 is a cord-retention means in the form of an open-ended metal sleeve 14 that frictionally engages the inside wall of shell 10 and has cord-gripping means 15, i.e., a number of inwardly directed prongs, formed on its inner end. While a cord can be inserted into cavity 13 through prong-ended sleeve 14, the prongs prevent the motion of the cord in the opposite direction when tension is applied thereto. Sleeve 14 extends from the open end of shell 10 to a plane which will place the end of the gripped cord in a plane normal to the axis of shell 10 which is axially spaced from the plane in which the boundary 16 of ignition charge 11 lies by a distance no greater than about 2.5 millimeters regardless of how incompletely the cord may be pushed into the cavity.

Preferably, the sleeve places the cord so that the cord end is axially spaced from the bottom of shell 10 by no more than about 5 millimeters.

The outer end of metal sleeve 14 is provided with a lip portion 17 that extends over the outer ends of shell 10 and grommet 12. Crimp 18 locks shell 10 in place, keeping it from becoming dislodged by the internal pressure produced when charge 11 ignites. Grommet 12 and circumferential crimps 19 and 20 in the side of shell 1 seal charges 2, 3, 5, and 11 off from the atmosphere.

Ignition charge 11 is one which is sensitive to ignition by a pressure pulse produced by the detonation of a low-energy detonating cord positioned coaxially in cavity 13 in a manner such that it is gripped by prongs 15.

Figure 2:
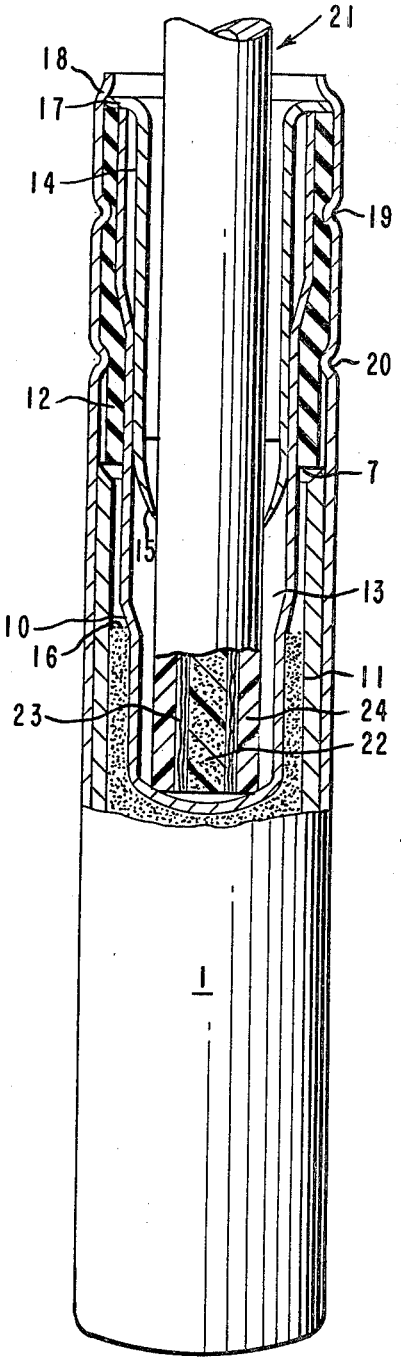
FIG. 2 is a view in partial cross-section of a delay detonator of the invention assembled with a low-energy detonating cord for the actuation thereof.

The detonator is a self-contained, sealed unit and can be stored, transported, and otherwise handled as required separated from the detonating cord with which it is designed to be used. At the time of use, the detonator can be assembled with the cord used to actuate it by inserting the cord into cavity 13 of shell 10 until it is gripped by prongs 15 and preferably becomes seated against the closed end of shell 10 as is shown in FIG. 2. Separation of the components of the detonator/cord assembly until use offers such advantages as safety and convenience during handling and storage, possible separate classification of the components for transportation, etc.

In the cord/detonator assembly shown in FIG. 2, an end-section of a length of low-energy detonating cord 21 is in coaxial position in cavity 13 of shell 10 and has its end touching the closed end of shell 10. Prongs 15 grip cord 21 and thus prevent it from being pulled out of cavity 13. In this embodiment, the plane that passes through the end of cord 21 within cavity 13 normal to the cord axis also passes through ignition charge 11. Cord 21 consists of a continuous solid core 22 of a deformable bonded detonating explosive composition, e.g., superfine PETN admixed with a binding agent such as plasticized nitrocellulose, core-reinforcement means 23 consisting of a mass of filaments derived from multi-filament yarns around and in contact with the periphery of core 22 parallel to the core's longitudinal axis; and a protective plastic sheath 24, which encloses core 22 and core-reinforcing filaments 23. Cords of this type are described in the aforementioned Belgian Pat. No. 863,290.

The use of the detonator and the cord/detonator initiating assembly of the invention will now be described by way of an example.

The detonator and cord are those shown in FIGS. 1 and 2. Shell 1 is a standard detonator shell, e.g., a shell made of commercial bronze, 42 mm long, and having an external diameter of 7.3 mm and a wall and bottom thickness of 0.3 mm. Base charge 2 consists of 0.49 gram of PETN, which has been placed in shell 1 and pressed therein at 1220–1335 Newtons with a pointed press pin. Priming charge 3 is 0.14 gram of and 85/15 mixture (by weight) of dextrinated lead azide and the coarse lead salt of dinitrocresylate, this mixture having been loaded into the shell and pressed at the same pressure as the base charge by a flat pin. Delay carrier 4 is a 7-mm-long swaged lead tube, and delay charge 5 is 0.2 gram of a 2/98 boron/red lead mixture, grained with polysulfide rubber. The diameter of the axial core of carrier 4 is 2 mm.

Capsule 6 is made of commercial bronze, is 11.1 mm long, and has a wall thickness of 0.6 mm. Axial orifice 9 is 2 mm in diameter. Capsule 6 is positioned over carrier 4 and pressed at 1220–1335 Newtons by a flat press pin. Ignition charge 11 is 0.08 gram of a 1.5/88.5/10 (by weight) boron/red lead/dextrinated lead azide mixture. Shell 10 is made of aluminum, and has a wall thickness of 0.56 mm, a bottom thickness of 0.64 mm, and an overall length of 19.8 mm. The outer diameter of shell 10 is 4.9. mm in a 6-mm-long section starting at the closed end; 5.6 mm in a 5-mm-long section starting at the open end; and 5.4 mm in an intermediate section therebetween. Grommet 12, made of low-density polyethylene and having a length of 9 mm, an outer diameter of 6.4 mm, and an inside diameter of 5.4 mm, is fitted onto shell 10 in a manner such that the edge surfaces of shell 10 and grommet 12 at the outer end are substantially coplanar. Bronze sleeve 14 has an overall length of 12 mm, an outer diameter of 4.5 mm, an inner diameter of 4 mm, and a 2.5-mm tapered portion having four cord-gripping prongs 15, which reduce the diameter of the sleeve at the gripping end to 2 mm. Sleeve 14 is fitted into shell 10 in a manner such that lip portion 17 rests over the ends of shell 10 and grommet 12. The assembly of shell 10, grommet 12, and sleeve 14 is pressed into shell 1 at 222–267 Newtons, thereby compacting ignition charge 11 in the spacing between the closed end of shell 10 and closed extremity 8 of capsule 6, and displacing some of charge 11 into the annular space between the facing walls of shell 10 and capsule 6. Vibrating the assembly upside down also moves ignition charge 11 into the annular space. Charge 11 extends about the length (6 mm) of the 4.9-mm outer-diameter section of shell 10, as can be seen by X-ray measurements, or by post-firing observation of shell 10. The inner end of grommet 12 rests against the surface of capsule 6 at the capsule's open extremity 7, and prongs 15 terminate in a plane normal to the longitudinal axis of sleeve 14 that is axially spaced from the plane in which the boundary 16 of ignition charge 11 lies by a distance of about 1.8 mm. In this manner, even if cord 21 were inserted into cavity 13 to the extent that it were gripped by prongs 15 without being pushed to the bottom of the shell, which action, as a practical matter, would normally cause the cord to extend at least about 3 millimeters beyond prongs 15, leaving a 4.8-mm gap between the cord end and the bottom of the shell, a 1.2 mm end-portion of the cord would be adjacent to charge 11, and the actuation of the ignition charge would be assured.

Cord 21 has an outer diameter of 2.5 mm, a 0.5-mm-diameter core (22), and a 0.6-mm-thick low-density polyethylene sheath (24). The core 22 consists of a mixture of 75% superfine PETN, 21% acetyl tributyl citrate, and 4% nitrocellulose prepared by the procedure described in U.S. Pat. No. 2,992,087. The average particle size of the superfine PETN is less than 15 microns, with all particles smaller than 44 microns. Core-reinforcing filaments 23 are derived from eight 1000-denier strands of polyethylene terephthalate yarn substantially uniformly distributed on the periphery of core 22. The PETN loading in core 22 is 0.53 gram per meter.

One end of a 7-meter length of cord 21 is inserted into cavity 13 of shell 10 as is described above. When cord 21 is detonated at its other end by a No. 6 blasting cap having its end in coaxial abutment with the exposed end of cord 21, or by the detonation transmitted to it from another detonating cord, e.g., in the cord/booster assembly described in co-pending, co-assigned U.S. application Ser. No. 006,013 filed Jan. 24, 1979 by Malak E. Yunan, the detonator fires, giving a delay period of 40 milliseconds. In operation, the detonation of core 22 causes shell 10 to expand and ignition charge 11 to be ignited as a result of being suddenly squeezed between shell 10 and capsule 6. The burning of ignition charge 11 ignites delay charge 5, which in turn ignites priming charge 3, causing base charge 2 to detonate.

For use in the cord/booster assembly of the aforementioned co-pending application Ser. No. 006,013 the free end of cord 21 of the cord/detonator assembly of this invention is inserted into the cavity of the booster shell as shown in the drawing of the co-pending application. More specifically, cord 13 shown in FIGS. 2 and 3 of the co-pending application is the same as cord 21 of this application. This cord is detonated by the detonation of a booster explosive, which in turn is detonated by a detonating cord positioned transversely outside and adjacent to the closed end of the shell containing the booster explosive.

In the detonator shown in FIG. 3, delay charge 5 is loaded directly into detonator shell 1 on top of priming charge 3, and a tubular metal spacer capsule 25 is nested within shell 1 in snug fit therein on top of charge 5. Capsule 25 has one open extremity 26 and a closed extremity 27 provided with an axial perforation 28. Capsule 25 is seated within shell 1 with closed extremity 27 resting adjacent to delay charge 5. Open extremity 26 faces the ignition assembly components 29, which includes heat-sensitive ignition composition 30 seated within thin-bottomed plastic ignition capsule or cup 31, and percussion-sensitive ignition charge 11 located between the side walls and closed ends of expansion shell 10 and metal ignition capsule 6. By way of an example, all elements are the same as was described for the detonator shown in FIG. 1, with the following additions or exceptions:

Delay charge 5 is loosely loaded into shell 1, which is longer than shell 1 of the FIG. 1 detonator to permit accommodation of capsule 25 and cup 31. Capsule 25, made of commercial bronze, is 11.9 mm long, and has a wall thickness of 0.5 mm. Axial perforation 28 is 2.8 mm in diameter. Capsule 25 is seated in shell 1 at 1290 Newtons. Plastic, e.g., polyethylene, ignition cup 31, seated onto capsule 25, contains 0.27 gram of a 2/98 boron/red lead mixture, grained with polysulfide rubber. Metal ignition capsule 6 is seated in shell 1 at 1110 Newtons whereby charge 11 contacts charge 30. In this embodiment, the ignition of charge 11 as a result of the detonation of cord 21 causes charge 30 to be ignited and the thin bottom of cup 31 to burn through, sending a hot, short-duration flash to the top of delay charge 5.

The detonator shown in FIG. 4 is the same as that shown in FIG. 3 except that plastic cup 31 and ignition composition 30 are omitted. In this detonator, metal ignition capsule 6 is seated directly adjacent to spacer capsule 25. A thin retention layer 32 of material capable of being perforated by the burning of charge 11, e.g., a plastic disk, is affixed to capsule 6 across perforation 9 to keep powder from falling through capsule 25. When charge 11 ignites, layer 32 is burned through, allowing delay charge 5 to be ignited.

While the detonator of this invention can be adapted to be actuated by any low-energy detonating cord, it is preferred that cords having a core explosive loading of less than about 1 gram per meter be used for this purpose, inasmuch as it is more difficult with heavier cords to maintain the sealed character of the detonator until after the delay charge has burned, a condition that is required if the predetermined delay timing is to be attained. Also, the type of cord described in the aforementioned Belgian patent is preferred because it would not be desensitized should its cut end come into contact with water, as could occur in field assembly.

The particular compositions selected for the various charges in the detonator are not critical to the present invention, provided that the selected compositions function in the specified manner. Thus, the composition selected to be used as the ignition charge 11 has to be one which is ignitible by percussion, i.e., by the sudden impact of the expanding shell 10 while the charge is held within the rigid capsule 6; reliably propagates the initiation stimulus from the detonating cord to the delay charge 5; and is substantially gasless when it decomposes, to prevent rupture of the surrounding capsule. Preferred ignition compositions consist essentially, by weight, of at least about 86% red lead (lead tetroxide), about from 1 to 2.5% boron, and up to about 11% lead azide, lead styphnate, or a mixture thereof. Certain of these compositions are described in U.S. Pat. No. 3,306,201, the disclosure of which is incorporated herein by reference. More-sensitive ignition compositions may be required in detonators to be used with detonating cords having smaller core loadings than in those used with cords having larger loadings.

The exothermic-burning composition used as the delay charge can be any of the gasless exothermic-reacting mixtures of solid oxidizing and reducing agents that burn at a constant rate and that are commonly used in ventless delay detonators. Examples of such mixtures are boron-red lead, boron-red lead-dibasic lead phosphite, aluminum-cupric oxide, magnesium-barium peroxide-selenium, and silicon-red lead. The delay charge may be present in the bore of a metal carrier, e.g., of lead, as is shown in FIG. 1, or it may be a simple layer adjacent to the priming charge, as in FIG. 3. The delay period is dependent upon the length or depth of the delay charge as well as its degree of compaction and confinement.

The priming charge can be any heat-sensitive detonating explosive composition which is readily initiated by the burning of the delay composition, e.g., lead azide, mercury fulminate, diazodinitrophenol, or a similar composition.

The composition used for the base charge can be any of the conventional base charges, e.g., PETN, cyclotrimethylenetrinitramine, cyclotetramethylenetetranitramine, lead azide, picryl sulfone, nitromannite, TNT, and the like. This charge can be loose or compacted.

The proper functioning of the detonator of this invention depends on (a) the expansion of shell 10 by the pressure pulse resulting from the detonation of a low-energy detonating cord located in the cavity of shell 10; and, in turn, (b) on the ignition of ignition charge 11 as a result of the sudden compression caused by this expansion. The presence of the ignition charge in the annular spacing between the side walls of the expansion shell 10 and the capsule 6 is a means of assuring the ignition of the ignition charge should cord 21 fail to be seated against the closed end of shell 10. To provide this gap capability, i.e., the ability for firing the detonator when there is a spacing between the end of cord 21 and the closed end of shell 10, the thickness of the ignition charge (wall spacing) should be at least 0.2 mm.

Conditions which lead to the collapse or rupture of shell 10 when charge 11 is ignited are to be avoided, otherwise the reproducibility of the delay period for a given delay charge may be deleteriously affected owing, for example, to a resulting decrease in internal pressure. Collapse and/or rupture of shell 10 is avoided by selecting a proper combination of shell material and wall thickness, and ignition composition and charge thickness (i.e., thickness of the spacing between the side walls of shell 10 and capsule 6). For a given shell material and wall thickness, the thickness of a given ignition composition can be reduced to assure the integrity of the expansion shell. Alternatively, if a reduction in ignition charge thickness is undesirable, e.g., to maintain gap capability, the wall thickness of the shell adjacent to the ignition charge can be increased (to the extent that shell expansion is not severely compromised) as a preventive measure against shell collapse. The outer diameter of expansion shell 10 is not critical provided that the annular spacing around it is sufficiently large to accommodate the required amount of ignition charge. If a single outer diameter of shell 10 is not suitable to accommodate a given size sleeve 14 and grommet 12, as well as the selected thickness of the annular portion of the ignition charge, the diameter of shell 10 can be varied along the length of the shell, as is shown in the drawing.

Because expansion shell 10 has to be deformable by the pressure pulse produced by the detonation of a low-energy detonating cord, it preferably is made of a metal such as aluminum or brass, and preferably has a wall thickness no greater than about 0.8 mm in the region adjacent to the ignition charge.

As has been mentioned previously, the presence of the ignition charge in the spacing between the walls of the expansion shell 10 and the capsule 6 permits the detonator to be fired even when the end of cord 21 is not seated against the closed end of shell 10. Because the cord is easily pushed into cavity 13 until it reaches the closed end of shell 10, however, the cord/detonator assembly usually, and preferably, will have the cord end touching the shell end.

In the usual and preferred case, therefore, the plane that passes through the end of the cord within cavity 13 normal to the cord axis passes also through the ignition charge. At least about a 2.5-mm end-portion of the cord preferably will be surrounded by the ignition charge whether the cord end touches the shell bottom or there is a gap between the two. With ignition charge surrounding at least a 2.5 mm endportion of the cord, the presence of foreign matter such as gritty particles in the gap between the cord end and the expansion shell bottom does not deleteriously affect the functioning of the detonator, a feature which is of great importance in a field-assembled detonator where foreign matter could enter cavity 13 before cord 21 is inserted.

The detonator will also function properly if there is an axial separation between the cord end and the ignition charge boundary, peferably a separation of no greater than about 2.5 mm. However, to provide an extra measure of reliability when there is a gap between the cord and the ignition charge, a shock-transmitting material, e.g., a layer of grease, preferably is present in cavity 13 at the inner end thereof.

To overcome the variations possible in the location of the cord end relative to the ignition charge when the detonator and cord are assembled in the field, the position of sleeve 14 controls the proper positioning of the cord. The length of sleeve 14 is selected so that the axial distance between the plane normal to the sleeve's axis in which its inner end (prongs 15) lies and the plane in which the boundary 16 of ignition charge 11 lies does not permit the axial spacing between the cord end and the charge boundary to exceed about 2.5 mm when the cord is just gripped by prongs 15 without further insertion. For example, if the axial distance between the prong ends and the charge boundary were no greater than about 5.5 mm, and if the cord were to be inserted into cavity 13 only to the extent that it were gripped by the prongs near the end of the cord without further pushing of the cord into the cavity, which action, practically speaking, would normally cause the cord to extend at least about 3 mm beyond the prongs, it would be impossible for the axial spacing between the cord end and the charge boundary to be more than about 2.5 mm. In the same manner, if the axial distance between the prong ends and the bottom of shell 10 were no greater than about 8 mm, the axial spacing between the cord end and the bottom of shell 10 could not exceed about 5 mm.

I claim:

1. In a non-electric delay detonator adapted to be actuated by a low-energy detonating cord and comprising a tubular metal detonator shell integrally closed at one end and containing, in sequence from the closed end, (a) a base charge of a detonating explosive composition, (b) a priming charge of a heat-sensitive detonating explosive composition, (c) a delay charge of an exothermic-burning composition, and an ignition charge, the improvement comprising an assembly, to be used in conjunction with said detonating cord, for igniting said delay charge, said assembly comprising:

(1) a tubular rigid metal ignition capsule having one open extremity and a closure at the other extemity, said capsule being nested within said detonator shell in a manner such that said closure is directed toward said delay charge;

(2) a tubular metal expansion shell integrally closed at one end, said expansion shell being deformable and positioned coaxially within said detonator shell in a manner such as to produce a spacing between the side walls of said expansion shell and of said ignition capsule, and between the closed end of said expansion shell and the closure on said ignition capsule; and (b 3) a percussion-sensitive ignition charge in the spacing between the side walls of said expansion shell and of said ignition capsule, and between the closed end of said expansion shell and said closure on said ignition capsule, said closure on said ignition capsule having an axial perforation or being adapted to be axially perforated by the burning of said ignition charge, and said delay charge being adapted to be ignited as a result of the burning of said ignition charge; means being provided for sealing the charges in said detonator shell off from the atmosphere and for preventing the venting of gases resulting from the burning of said ignition charge, an open cavity extending from one end to the other of said expansion shell for receiving a low-energy detonating cord adapted by its detonation to produce a pressure pulse that causes the ignition of said ignition charge, and means being provided for retaining said cord coaxially in said cavity.

2. The detonator of claim 1 wherein said cord-retention means is in said cavity.

3. The detonator of claim 2 wherein the closure on said ignition capsule is adjacent to said delay charge or to a tubular carrier containing said delay charge, and said ignition charge is in contact with said delay charge by virtue of an axial perforation in the closure on said ignition capsule.

4. The detonator of claim 3 wherein a delay carrier comprising a heavy-walled tube of rigid material containing an axial core of said delay charge is interposed between said priming charge and the closure on said ignition capsule, said core being coaxial, and in communication, with the perforation in said closure to permit contact between said delay charge and said ignition charge.

5. The detonator of claim 1 wherein a tubular metal spacer capsule having one open extremity and an axially perforated closure at the other extremity is interposed between said delay charge and said ignition assembly.

6. The detonator of claim 5 wherein the open extremity of said spacer capsule faces the closure on said ignition capsule, and the axially perforated closure on said spacer capsule is adjacent to said delay charge or to a tubular carrier containing said delay charge.

7. The detonator of claim 6 wherein said ignition capsule is adjacent to said spacer capsule.

8. The detonator of claim 6 wherein a rigid capsule of nonflammable plastic is interposed between said ignition and spacer capsules, said plastic capsule having (a) an open end facing said ignition capsule and a closed end facing said spacer capsule, and (b) side walls of substantially greater thickness than its closed end, and containing a heat-sensitive ignition charge in contact with the percussion-sensitive ignition charge in said metal ignition capsule by virtue of an orifice in the latter's closure, and the closed end of said plastic capsule being adapted to be perforated axially by the burning of the ignition charge therein.

9. The detonator of claim 2 wherein said cord-retention means is an open-ended sleeve having cord-gripping means associated therewith, said sleeve frictionally engaging the inside wall of said expansion shell and extending from the open end of said expansion shell toward the center of said cavity.

10. The detonator of claim 9 wherein said cord-gripping means consists of at least one inwardly directed prong formed on the inner end of said sleeve.

11. The detonator of claim 10 wherein the inner end of said sleeve lies in a plane normal to the axis thereof that also passes through said ignition charge or, if not, is spaced from the plane in which the boundary of said ignition charge lies by a distance no greater than about 5.5 millimeters.

12. The detonator of claim 11 wherein the inner end of said sleeve lies in a plane normal to the axis thereof that is spaced from the bottom of said expansion shell by a distance no greater than about 8 millimeters.

13. The detonator of claim 1 wherein a deformable grommet is sandwiched between said detonator and expansion shells starting from their open ends and extending approximately to the open extremity of said metal ignition capsule, said shells and grommet being held together by one or more circumferential side crimps.

14. The detonator of claim 9 wherein said sleeve is made of metal and, at its outer end, is provided with a lip portion that extends over the end of said expansion shell or over a conforming lip portion on the end of said expansion shell.

15. The detonator of claim 1 wherein said ignition charge is a pressed granular mixture consisting essentially, by weight, of at least about 86% red lead; about from 1 to 2.5% boron; and up to about 11% lead azide, lead styphnate, or a mixture thereof.

16. A non-electric assembly for initiating a blasting charge comprising a tubular metal detonator shell integrally closed at one end, said detonator shell containing, in sequence from the closed end:

(a) a base charge of a detonating explosive composition;

(b) a priming charge of a heat-sensitive detonating explosive composition;

(c) a delay charge of an exothermic-burning composition;

(d) a tubular rigid metal ignition capsule having one open extremity and a closure at the other extremity, said capsule being nested within said detonator shell in a manner such that said closure is directed toward said delay charge;

(e) a tubular metal expansion shell integrally closed at one end, said expansion shell being deformable and positioned coaxially within said detonator shell in a manner such as to produce a spacing between the side walls of said expansion shell and of said ignition capsule, and between the closed end of said expansion shell and the closure on said ignition capsule;

(f) a percussion-sensitive ignition charge in the spacing between the side walls of said expansion shell and of said ignition capsule, and between the closed end of said expansion shell and said closure on said ignition capsule, said closure on said ignition capsule having an axial perforation or being adapted to be axially perforated by the burning of said ignition charge, and said delay charge being adapted to be ignited as a result of the burning of said ignition charge; means being provided for sealing off said charges from the atmosphere and for preventing the venting of gases resulting from the burning of said ignition charge, and an open cavity extending from one end to the other of said expansion shell;

(g) an end-section of a length of lowenergy detonating cord in the cavity of said expansion shell; and (h) cord-retention means in said cavity for holding said cord in coaxial position therein in a manner such that the plane that passes through the end of the cord within said cavity normal to the cord axis also passes through said ignition charge or if not, is spaced from the plane in which the boundary of said ignition charge lies by a distance no greater than about 2.5 millimeters.

17. The initiating assembly of claim 16 wherein said detonating cord has an explosive core loading of about from 0.2 to 1 gram per meter of length.

18. The initiating assembly of claim 17 wherein said low-energy detonating cord comprises a continuous solid core of a deformable bonded detonating explosive composition comprising a crystalline high explosive compound admixed with a binding agent, and a protective plastic sheath enclosing said core.

19. The initiating assembly of claim 16 wherein said cord-retention means holds said cord in a manner such that the plane that passes through the end of the cord also passes through said ignition charge.

20. The initiating assembly of claim 19 wherein the end of said cord is seated against the closed end of said expansion shell.

21. The initiating assembly of claim 16 wherein said cord-retention means is an open-ended sleeve having cord-gripping means associated therewith, said sleeve frictionally engaging the inside wall of said expansion shell and extending from the open end of said expansion shell toward the center of said cavity.

22. The initiating assembly of claim 21 wherein said cord-gripping means consists of at least one inwardly directed prong formed on the inner end of said sleeve.

23. The initiating assembly of claim 22 wherein the inner end of said sleeve lies in a plane normal to the axis thereof that also passes through said ignition charge or, if not, is spaced from the plane in which the boundary of said ignition charge lies by a distance no greater than about 5.5 millimeters.

24. The initiating assembly of claim 23 wherein the inner end of said sleeve lies in a plane normal to the axis thereof that is spaced from the bottom of said expansion shell by a distance no greater than about 8 millimeters.

* * * * *